US006012441A

United States Patent [19]

Liu

[11] Patent Number: 6,012,441

[45] Date of Patent: Jan. 11, 2000

[54] ON BASE OF CERAMIC TILE CUTTER

[76] Inventor: Yi-Hua Liu, No. 1-21, Ta Hsin Road, Tan Tsu Hsian, Taichung Hsien, Taiwan

[21] Appl. No.: 09/127,905

[22] Filed: Aug. 3, 1998

[51] Int. Cl.[7] ..... B28D 7/04

[52] U.S. Cl. ..... 125/35; 125/1; 125/42; 225/96.5; 144/287; 451/414

[58] Field of Search ..... 125/35, 42, 1; 451/364, 365, 378, 380, 406, 411, 412, 414; 269/309, 311, 298, 301; 225/96.5; 144/287

[56] References Cited

U.S. PATENT DOCUMENTS

| | | | |
|---|---|---|---|
| 1,864,840 | 6/1932 | Lehner | 144/287 |
| 3,371,833 | 3/1968 | Sutton | 225/96.5 |
| 4,860,807 | 8/1989 | Vacchiano | 144/287 |
| 4,912,881 | 4/1990 | McDougall | 451/414 |
| 5,083,403 | 1/1992 | Otterbein, II | 451/413 |
| 5,169,045 | 12/1992 | Liu | 225/96.5 |
| 5,560,274 | 10/1996 | Turner | 225/96.5 |
| 5,615,665 | 4/1997 | Thiriet | 225/96.5 |

*Primary Examiner*—Robert A. Rose
*Assistant Examiner*—George Nguyen
*Attorney, Agent, or Firm*—Browdy and Neimark

[57] ABSTRACT

A ceramic tile cutter is provided with at least one auxiliary base which is fastened pivotally with one longitudinal side of a base of the ceramic tile cutter such that the upper surface of the auxiliary base is lower than the crest of a ridged portion of the base. The auxiliary base can be swiveled to give an added width to the base so as to facilitate the locating of an oversize ceramic tile on the base of the ceramic tile cutter.

7 Claims, 2 Drawing Sheets

ON BASE OF CERAMIC TILE CUTTER

FIELD OF THE INVENTION

The present invention relates generally to a ceramic tile cutter, and more particularly to an improved base of the ceramic tile cutter.

BACKGROUND OF THE INVENTION

The prior art ceramic tile cutter is generally composed of a rectangular base, which is provided respectively at both ends thereof with a support frame. Located between the two support frames is at least one guide rod which is provided with a slide seat fastened pivotally therewith. A cutting tool seat is mounted pivotally on the slide seat such that a round cutting tool is fastened pivotally with the bottom of the cutting tool seat, and that a press plate is fastened pivotally behind the cutting tool, and further that a handle is mounted over the cutting tool seat. The base is provided at the center thereof with a ridged portion extending along the longitudinal axis of the base and having respectively on both sides thereof an elastic pad. The base is provided at one end thereof with a locating member. In operation, a ceramic tile is placed on the base such that one end of the ceramic tile is pressed against the locating member. With one hand holding the handle, the operator forces the cutting tool to press against the surface of the ceramic tile. The slide seat is then moved from one end toward the other end which is provided with the locating member. A cutting line is made on the surface of the ceramic tile by the cutting tool such that the cutting line is corresponding in location to the ridged portion. The handle is then lifted, whereas the both sides of the cutting line are pressed by the press plate such that the cutting line is urged by the ridged portion, and that the elastic pad is pressed to deform. The ceramic tile is cut along the cutting line.

The base of the prior art ceramic tile cutter described above is defective in design in that the width of the base is insufficient to accommodate stably a large ceramic tile having a size of 40×40 cm or even a size of 60×60 cm. If the cutting line is located near the margin of a large ceramic tile, the base is not wide enough to accommodate stably the large ceramic tile. As a result, one hand of the operator must be used to hold the large ceramic tile so as to facilitate the cutting of the tile by the tile cutter.

SUMMARY OF THE INVENTION

The primary objective of the present invention is therefore to provide a ceramic tile cutter with a base capable of accommodating stably a large ceramic tile.

In keeping with the principle of the present invention, the foregoing objective of the present invention is attained by a ceramic tile cutter consisting of a base which is provided in the center thereof with a ridged portion extending along the direction of the longitudinal axis of the base. The base is further provided with two elastic pads along both sides of the ridged portion, and a locating member disposed at one end of the base for locating a ceramic tile placed on the base. The base is provided along one longitudinal side thereof with an auxiliary base fastened pivotally therewith. The auxiliary base can be swiveled to give an added width to the base for accommodating a large ceramic tile stably.

The foregoing objective, features, functions and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
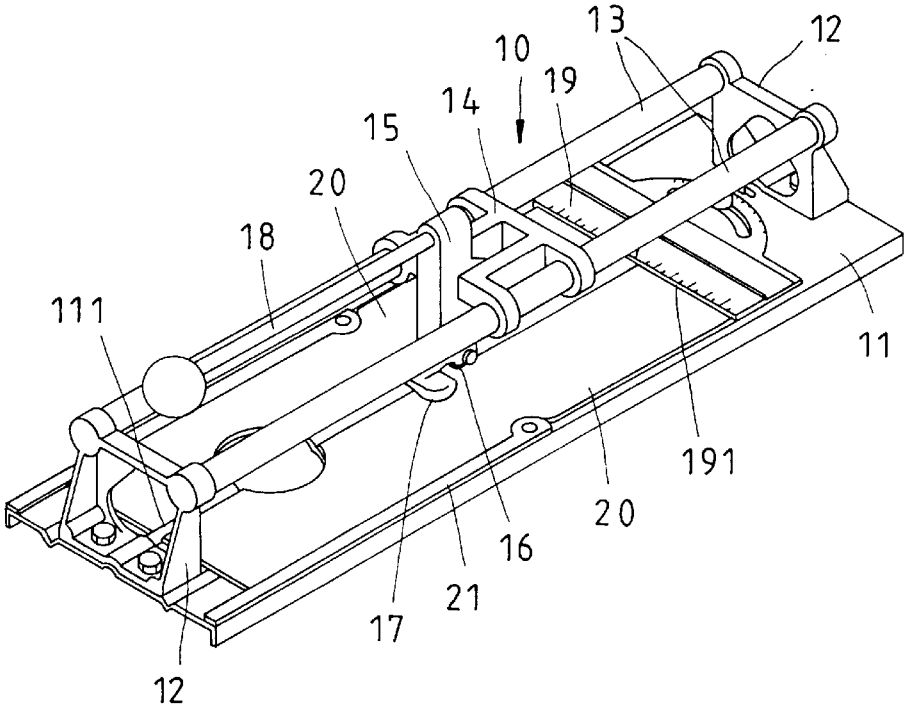
FIG. 1 shows a perspective view of the embodiment of the present invention.
Figure 3:
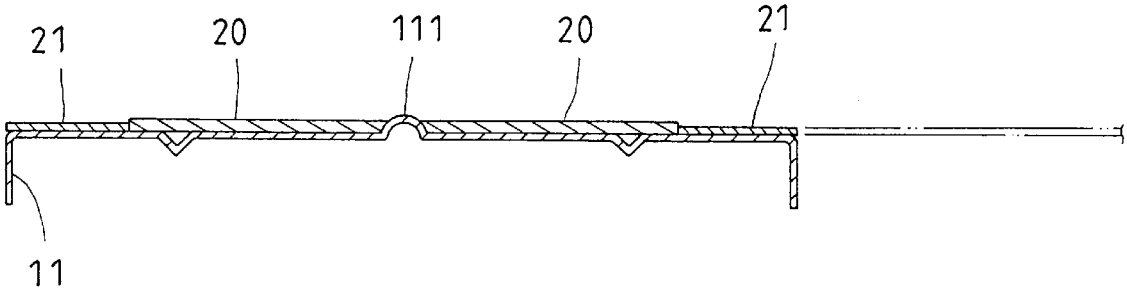
FIG. 3 shows a sectional view of a portion taken along a line 3—3 as shown in FIG. 2.
Figure 2:
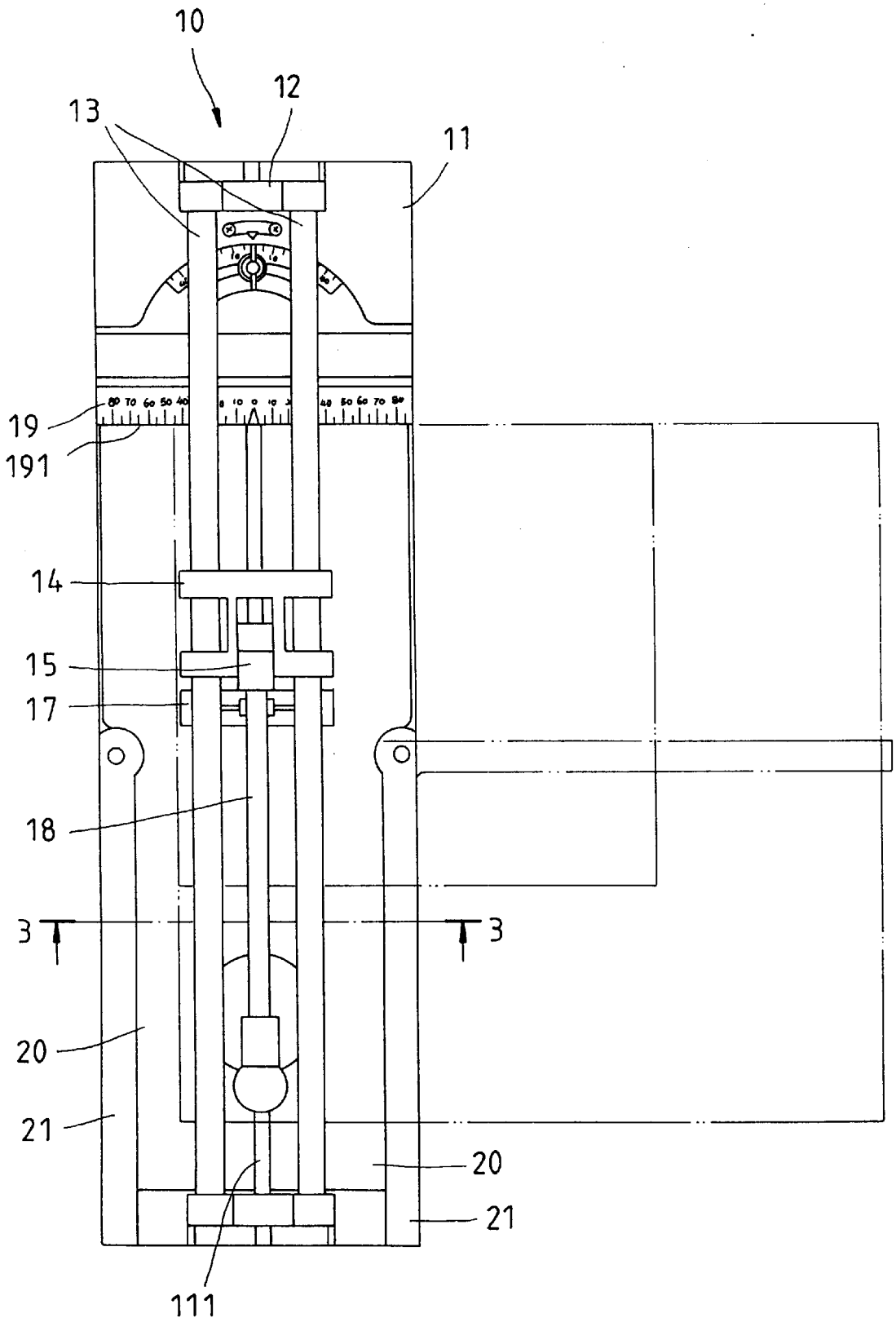
FIG. 2 shows a top view of the embodiment of the present invention, with the imaginary lines indicating the state of the use of the disposing of a ceramic tile.

As shown in FIGS. 1–3, a ceramic tile cutter 10 of the preferred embodiment of the present invention is composed of a main base 11, two support frames 12, two guide tubes 13, a slide seat 14, a cutting tool seat 15, a round cutting tool 16, a press plate 17, a handle 18, a locating member 19, two elastic pads 20, and two auxiliary bases 21.

The main base 11 is of a rectangular shape and provided in the center of the upper surface thereof with a ridged portion 111 extending along the direction of the longitudinal axis of the main base 11. The two support frames 12 are mounted at both longitudinal ends of the main base 11 such that the two guide tubes 13 are mounted between the two support frames 12. The two guide tubes 13 are parallel to each other. The slide seat 14 is slidably mounted on the two guide tubes 13. The cutting tool seat 15 is pivotally mounted on the slide seat 14 such that the round cutting tool 16 is fastened pivotally with the bottom of the cutting tool seat 15. The round cutting tool 16 is capable of displacing along with the cutting tool seat 15 such that the cutting line of the round cutting tool 16 is in agreement with the line of the longitudinal axis of the top of the ridged portion 111. The press plate 17 is fastened pivotally with the bottom of the cutting tool seat 15 such that the press plate 17 is located behind the round cutting tool 16. The handle 18 is mounted on the cutting tool seat 15 for moving the slide seat 14 with hand of an operator. The press plate 17 can be pressed by the handle 18. The locating member 19 is secured to one end of the longitudinal ends of the main base 11 and is provided with an upright surface 191 for locating a ceramic tile which is placed on the main base 11. The two elastic pads 20 are located oppositely on both longitudinal sides of the ridged portion 111 such that the upper surfaces of the two elastic pads 20 are slightly lower than the crest of the ridged portion 11 1. The component parts described above are similar in structure and function to those of the prior art ceramic tile cutter.

The embodiment of the present invention is characterized in design in that the main base 11 of the present invention is provided with two auxiliary bases 21 which are fastened respectively and pivotally to the midsection of the two longitudinal sides of the main base 11. The auxiliary bases 21 can be swiveled on a pivot such that the auxiliary bases 21 can give an added width to the main base 11 to accommodate stably an oversized ceramic tile. In the meantime, the auxiliary bases 21 can be swiveled on the pivot such that they are located on the base 11. The auxiliary bases 21 may be provided at one or both free ends thereof with a curved support surface of a sectoral or triangular shape. The auxiliary bases 21 are basically striplike in shape.

The upper surfaces of the auxiliary bases 21 are lower than the upper surfaces of the two elastic pads 20. The upper surfaces of the two elastic pads 20 are lower than the crest of the ridged portion 111 of the main base 11.

The pivoting points of the auxiliary bases 21 may be located at any point along the longitudinal sides of the main base 11, preferably at the midpoint or in proximity of the end devoid of the locating member 19 in view of the fact that the auxiliary bases 21 can be operated normally even if the upper surfaces of the auxiliary bases 21 are higher than the crest of the ridged portion 111. If the pivoting points of the auxiliary bases 21 are located near the locating member 19, the auxiliary bases 21 must be located such that the upper surfaces of the auxiliary bases 21 are lower than the crest of the ridged portion 111, so as to facilitate the cutting operation of the ceramic tile.

The elastic pads 20 should be provided with a cut to facilitate the auxiliary bases 21 to be located on the base 11 at the time when the auxiliary bases 21 are retracted. In addition, the elastic pads 20 may be provided in the sides thereof with a restriction portion for confining the swiveling angle of the auxiliary bases 21. The auxiliary bases 21 may be fastened pivotally with the main base 11 by a rivet or screw.

What is claimed is:

1. A base of a ceramic tile cutter, said base being rectangular in shape and having a ridged portion extending along the direction of a longitudinal axis of said base, said base provided thereon with two elastic pads located on two sides of said ridged portion, said base further provided at one longitudinal end thereof with a locating portion having a surface perpendicular to the longitudinal axis of said base for locating a ceramic tile placed on said base; wherein said base is provided with at least one auxiliary base which is fastened pivotally with one longitudinal side of said base.

2. The base as defined in claim 1, wherein said ridged portion has a crest; and wherein said auxiliary base is fastened with said base such that an upper surface of said auxiliary base is lower than said crest of said ridged portion.

3. The base as defined in claim 1, wherein said two elastic pads have an upper surface; wherein said ridged portion has a crest higher than said upper surface of said two elastic pads; and wherein said auxiliary base has an upper surface lower or equal in level to the upper surface of said elastic pads.

4. The base as defined in claim 1, wherein said auxiliary base is of a striplike construction.

5. The base as defined in claim 4, wherein said auxiliary base is fastened pivotally at one end thereof with a midpoint of the one longitudinal side thereof such that said auxiliary base can be swiveled to locate on said base, and that a free end of said auxiliary base faces other end devoid of said locating portion.

6. The base as defined in claim 4, wherein said auxiliary base is fastened pivotally at one end thereof with the other end devoid of said locating member such that said auxiliary base can be swiveled to locate on said base, and that a free end of said auxiliary base faces said locating member.

7. The base as defined in claim 1, wherein said base is provided with two auxiliary bases fastened pivotally with two longitudinal sides of said base.

* * * * *